United States Patent [19]

Fujita

[11] Patent Number: 4,841,573

[45] Date of Patent: Jun. 20, 1989

[54] STEREOPHONIC SIGNAL PROCESSING CIRCUIT

[75] Inventor: Shinichi Fujita, Hamamatsu, Japan

[73] Assignee: Yamaha Corporation, Hamamatsu, Japan

[21] Appl. No.: 237,986

[22] Filed: Aug. 29, 1988

[30] Foreign Application Priority Data

Aug. 31, 1987 [JP] Japan ..... 62-217521

[51] Int. Cl.[4] ..... H04S 3/00

[52] U.S. Cl. ..... 381/27; 381/106

[58] Field of Search ..... 381/17, 18, 19, 22, 381/24, 27, 106, 1; 333/14

[56] References Cited

U.S. PATENT DOCUMENTS

| | | | |
|---|---|---|---|
| 3,952,157 | 4/1976 | Takahashi et al. | 381/22 |
| 4,392,019 | 7/1983 | Halliday | 381/19 |
| 4,685,136 | 8/1987 | Latshaw | 381/27 |
| 4,736,434 | 4/1985 | Filliman | 381/106 |
| 4,747,142 | 5/1988 | Tofte | 381/27 |

*Primary Examiner*—Forester W. Isen

*Attorney, Agent, or Firm*—Spensley Horn Jubas & Lubitz

[57] ABSTRACT

A stereophonic signal processing circuit is designed to be provided with a pair of level compression circuits compressing peak levels of a pair of stereophonic input signals into ½ power each, an arithmetic mean circuit determining an arithmetic mean between a pair of output signals issued from the level compression circuits, and a level expansion circuit expanding a peak level of an output signal from the arithmetic mean circuit into the 2nd power of the level so that an output signal from the level expansion circuit is reproduced midway between individual reproducing positions of the pair of stereophonic input signals. A delay circuit may be connected between the arithmetic mean circuit and the level expansion circuit. The stereophonic signal processing circuit makes it possible to cause more fully the lateralization of a reproduced sound and can be fabricated at a low cost.

3 Claims, 3 Drawing Sheets

STEREOPHONIC SIGNAL PROCESSING CIRCUIT

BACKGROUND OF THE INVENTION (a) Field of the Invention

The present invention relates to a stereophonic signal processing circuit producing, from 2-channel stereophonic signals, a center channel signal to be located midway between them.

(b) Description of the Prior Art

In the past, attempts have been made that a loudspeaker for a center channel is arranged midway between individual loudspeakers for a 2-channel stereophonic sound system, or alternatively a loudspeaker for a center channel is arranged midway between individual loudspeakers for two channels provided in the front, among individual loudspeakers for a 4-channel stereophonic sound system, thereby improving the localization of a sound field. FIG. 1 shows a general arrangement as described above.

Referring now to FIG. 1, stereophonic signals L, R supplied to a pair of stereophonic signal input terminals 1L, 1R are reproduced as sounds by loudspeakers 2L, 2R, respectively through power amplification. A center channel producing circuit 3 is adapted to produce a center channel signal C to be reproduced by a loudspeaker 2C for a center channel in accordance with the stereophonic signals L, R. Further, a reproduced sound derived from these signals is picked up by the ears of an audience 4 with the result that sound lateralization is brought about.

For a producing system of the center channel signal, various ones have been known from the past. There is the system, as a typical one, that a simple monaural output is supplied to the loudspeaker 2C for the center channel. This is such that, for example, the signal of an L channel is added to that of an R channel and then these signals are multiplied by $\frac{1}{2}$ to produce the center channel signal.

Also, a system referred to as Dolby Surround "Pro-logic" proposed by Dolby Laboratories (Dolby is a trademark of Dolby Laboratories Licensing Corp.) has outputs for a total of four channels provided on the front and rear sides and the left and right sides with respect to stereophonic signal inputs comprising an L channel and an R channel. Further, the outputs on the left, right, front (center) and rear sides are subject to control by a VCA (voltage control amplifier) in accordance with individual output levels of L, R, L+R and L−R so that the sound lateralization of the reproduced sound is caused.

In the foregoing prior art, however, the following problems have been encountered.

First, in the case of the simple monaural output, the sound lateralization of the reproduced sound cannot completely be brought about. Specifically, since the center channel output C is determined from $$C=(L+R)/2,$$

if L=R, the center channel output C attains the same level as in L and R channel outputs, while on the other hand, if L=0 for example, the center channel output C is reduced to the level of half of the R channel output. Accordingly, even if the output of the R channel only is obtained, the output of half (a quarter in sound pressure) of the R channel output is generated from the center channel and as such the localization of the reproduced sound is under a bias toward the inside (L side).

Second, in the case of Dolby Surround "Pro-logic", not only the complication of the system causes level setting to be difficult, but the L and R channel signals themselves are processed, with the result that their qualities are deteriorated.

SUMMARY OF THE INVENTION

It is therefore a primary object of the present invention to provide a stereophonic signal processing circuit which can easily meet the variation of an input level and which can enhance more sufficiently the sound lateralization of a produced sound.

Another object of the present invention is to provide a stereophonic signal processing circuit which is low in cost and which is simple in arrangement.

The stereophonic signal processing circuit of the present invention is characterized by being provided with first and second level compression circuits compressing first and second channel signals, in accordance with levels $V_1$, $V_2$ thereof, into the levels of $V_1^{\frac{1}{2}}$ times and $V_2^{\frac{1}{2}}$ times, respectively; an arithmetic mean circuit determining an arithmetic mean between individual output signals of the first and second level compression circuits; and a level expansion circuit expanding the output signal of the arithmetic mean circuit, in accordance with a level $V_3$ thereof, into the level of $V_3^2$ times to produce the output signal of the level expansion circuit as a third channel signal to be reproduced midway between individual reproducing positions of the first and second channel signals.

According to the present invention, the first and second channel signals whose levels are $V_1$ and $V_2$ are compressed into the levels of $V_1^{\frac{1}{2}}$ times and $V_2^{\frac{1}{2}}$ times, respectively, followed by the arithmetic mean and the output of the arithmetic mean is expanded, in accordance with the level $V_3$ thereof, into the level of $V_3^2$ times, so that the third channel signal C to be reproduced in the midway position is expressed by $$C=\{(V_1^{\frac{1}{2}}+V_2^{\frac{1}{2}})/2\}^2=V_1/4+V_2/4+(V_1^{\frac{1}{2}}\cdot V_2^{\frac{1}{2}})/2$$

Therefore, even in the case of L=0 mentioned above, C=R/4 is obtained to make it possible to minimize the bias and enhance more sufficiently the sound lateralization of a reproduced sound.

These and other objects as well as the features and the advantages of the present invention will become apparent from the detailed description of the preferred embodiment in conjunction with the accompanying drawings.

DESCRIPTION OF THE PREFERRED EMBODIMENT

Figure 1:
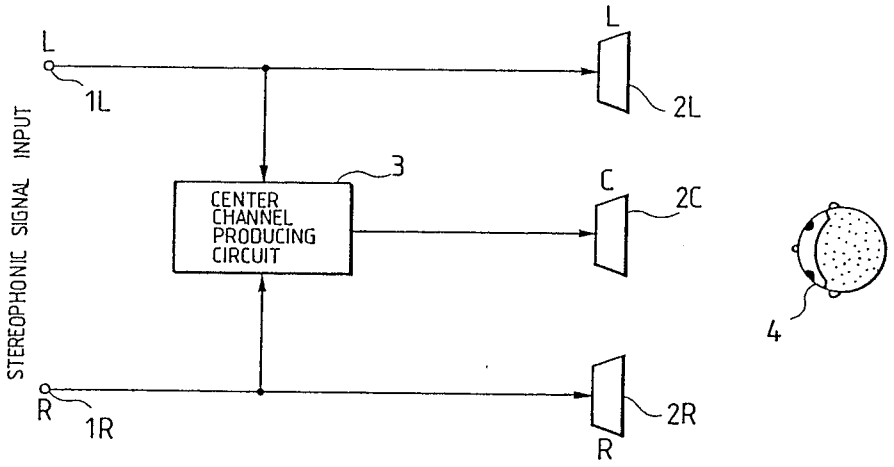
FIG. 1 is a view showing a conventional arrangement for a center channel production.
Figure 2:
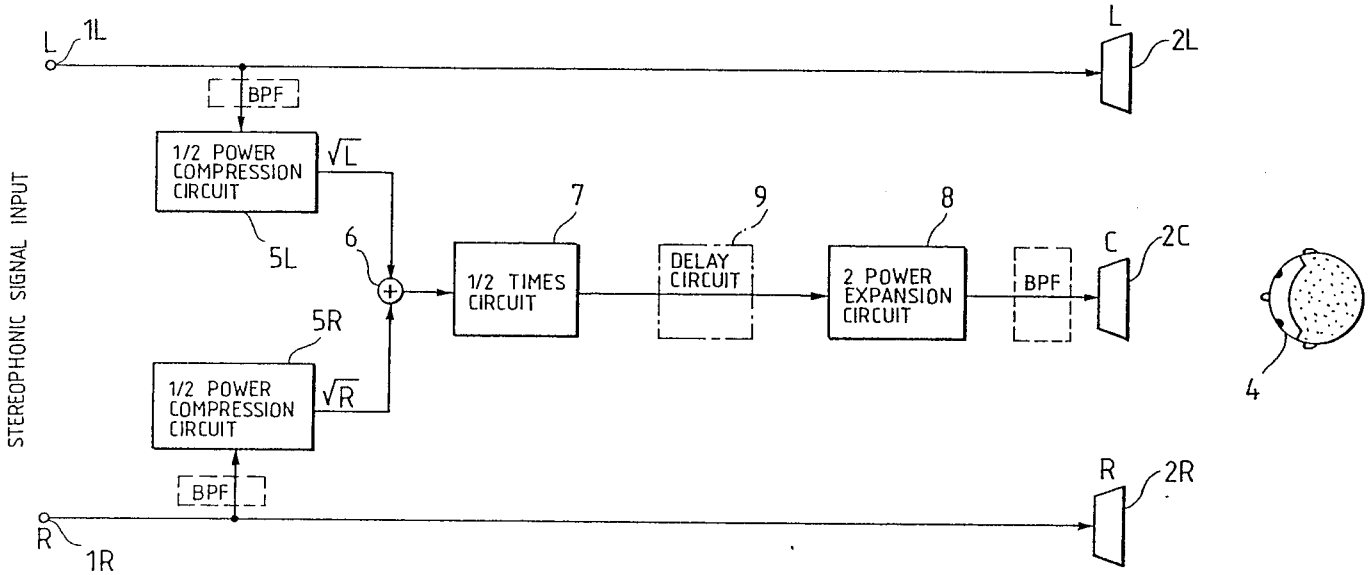
FIG. 2 is a block diagram showing a basic arrangement of an embodiment of the present invention.

Referring now to FIGS. 2 and 3, the embodiment of the present invention will be described in the following.

FIG. 2 is a block diagram showing the arrangement of an embodiment of the present invention. In this figure, stereophonic signals L, R supplied to stereophonic signal input terminals 1L, 1R are reproduced, through power amplification, by loudspeakers 2L, 2R provided on the left and right sides, respectively, and also are transmitted to $\frac{1}{2}$-power compression circuits 5L, 5R, respectively, connected to the input terminals. Although the $\frac{1}{2}$-power compression circutis 5L, 5R are adapted to compress L and R channel signals, respectively, in accordance with corresponding levels, it should be noted that each compression is not performed with respect to an instantaneous value of the signal, but to its peak level (envelope level). Respective output signals $L^{\frac{1}{2}}$, $R^{\frac{1}{2}}$ of the $\frac{1}{2}$-power compression circuits 5L, 5R are added by an adder 6 and are reduced to $\frac{1}{2}$ times the level by a $\frac{1}{2}$ times circuit 7 and thereby what it called an arithmetic mean is attained. That is, the adder 6 and the $\frac{1}{2}$ times circuit 7 constitute an arithmetic mean circuit. Further, an arithmetic mean output delivered from the arithmetic mean circuit is transmitted to a 2-power expansion circuit 8 where 2-power expansion is performed with respect to the peak level of the arithmetic mean output, and the resultant signal is provided, after power-amplified, to a loudspeaker 2C placed in a position midway between the loudspeakers 2L, 2R, as a center channel signal C.

Here, the $\frac{1}{2}$-power compression circuits 5L, 5R and the 2-power expansion circuit 8 described in the foregoing can be configured from ICs for operation which are widely on the market. This, therefore, renders it unnecessary to assemble specific circuits. In addition, each circuit of the present invention, which is of a self operation type, does not required to be provided with a so-called external control logic.

Next, the functions of the foregoing embodiment will be explained.

When the levels of the channel signals on the left and right sides are taken as L and R, respectively, the center channel signal output C is given by $$\begin{aligned} C &= \{(V_1^{\frac{1}{2}} + V_2^{\frac{1}{2}})/2\}^2 \\ &= L/4 + R/4 + L^{\frac{1}{2}} \cdot R^{\frac{1}{2}}/2 \end{aligned} \quad (1)$$

Then, assuming that, in the levels of the channel signals, L=R, the output C is expressed, from formula (1), by $$\begin{aligned} C &= L/4 + L/4 + L^{\frac{1}{2}} \cdot L^{\frac{1}{2}}/2 \\ &= L = R \end{aligned}$$

This is the same as in the case of the monaural output previously explained in connection with the description of the prior art and consequently a reproduced sound is located midway between the loudspeakers 2L, 2R for the channels provided on the left and right sides.

In contrast to this, assuming that L=0, the output C is expressed, from formula (1), by $$\begin{aligned} C &= O/4 + R/4 + O^{\frac{1}{2}} \cdot R^{\frac{1}{2}}/2 \\ &= R/4 \end{aligned}$$

This value is $\frac{1}{2}$ as compared with the case of the monaural output mentioned above and as such the extent that the reproduced sound is biased to the inside is reduced.

Figure 3A:
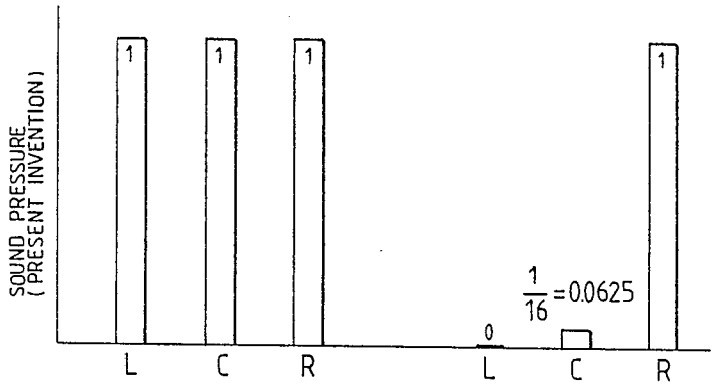
FIGS. 3A and 3B are sound pressure comparison graphs for comparing the advantages of the present invention with those of the prior art.
Figure 3B:
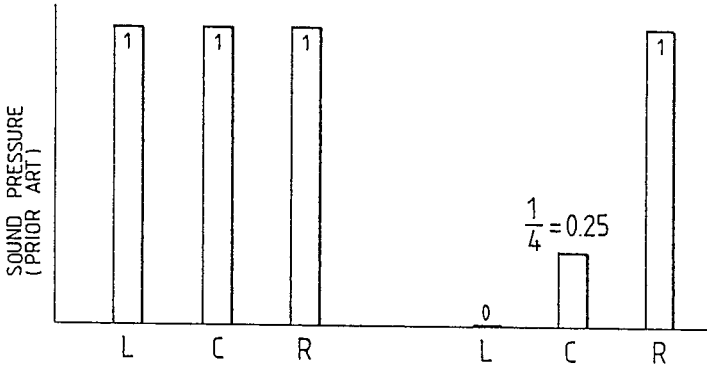

The comparison among individual channel signal outputs described above by sound pressure derived from the loudspeakers 2L, 2R 2C is as depicted in FIGS. 3A and 3B. specifically, since sound pressure is multiplied by the square of each signal output, the sound pressure of the center channel in L=0 becomes $\frac{1}{4}$ as compared with the conventional monaural output. Further, the circuit configurations according to the present invention are characterized in that the circuits are operated by self levels and the output C of the center channel is always relatively equivalent to either input level of the channel signals L, R issued on the left and right sides, with the result that such functions and advantages as mentioned above are effectively brought about at all times.

The present invention is not limited to the above embodiment, but may variously be modified.

For instance, even if a delay circuit 9 is interposed between the arithmetic mean circuit and the 2-power expansion circuit as indicated by a chain line in FIG. 2, preceding advantages of intensifying the level can likewise be brought about. Further, although the level is varied between them, the same advantages are gained unless the level changes on the output side. Moreover, the present invention is applicable not only to the stereophonic sound system for two channels provided in the front, but to a stereophonic sound system for a total of four channels provided in the front and rear. Furthermore, the application of the present invention is not limited to the processing of an analog signal, but is effective for the processing of a digital signal.

Also, when band-pass filters with the band of, for example, 200 Hz–7 KHz, are individually provided on the input sides of the $\frac{1}{2}$-power compression circuit 5L, 5R and on the output side of the 2-power expansion circuit 8 as indicated by broken lines in FIG. 2, the following effects can be brought about. Since a sound source to be situated to the center channel has principally a moderate band component such as a human voice, components other than the moderate band component can be excluded so that they are prevented from adversely affecting the production of the center channel. In particular, a low band component has a significant effect, though it originally has no sound lateralization, on a circuit for the production of the center channel which operates in level and as such it is preferable that such a component is removed in the production of the center channel.

Because, as described in the foregoing, the channel signals which have been inputted are subjected to the $\frac{1}{2}$-power compression in accordance with their levels, followed by the arithmetic mean and the 2-power expansion to be reproduced in the midway position, it becomes possible to cause more strongly the lateralization of the reproduced sound. Also, each circuit is of a self operation type, so that the same effect is obtained in regard to any input level. In addition, the $\frac{1}{2}$-power compression circuits and the 2-power expansion circuit necessary for the circuit configurations of the present invention can easily be constructed from ICs which are commercially extensively available and thus have advantages that the cost is reduced and the complication of the arrangement is avoided.

What is claimed is:

1. A stereophonic signal processing circuit, comprising;

a first channel signal input terminal;

a first level compression circuit connected to said first channel signal input terminal and compressing a peak level of a first channel signal inputted to said first channel signal input terminal, into $\frac{1}{2}$ power of the level;

a second channel signal input terminal;

a second level compression circuit connected to said second channel signal input terminal and compressing a peak level of a second channel signal inputted to said second channel signal input terminal, into $\frac{1}{2}$ power of the level;

an arithmetic mean circuit connected to individual output terminals of said first and second level compression circuits and determining an arithmetic mean between individual output signals emanating from said first and second level compression circuits; and a level expansion circuit connected to an output terminal of said arithmetic mean circuit and expanding a peak level of an output signal emanating from said arithmetic mean circuit, into 2nd power of the level, an output signal emanating from said level expansion circuit being produced as a third channel signal to be reproduced midway between individual reproducing positions of said first and second channel signals.

2. A stereophonic signal processing circuit according to claim 1, further comprising a delay circuit interposed between said arithmetic mean circuit and said level expansion circuit.

3. A stereophonic signal processing circuit according to claim 1, further comprising band-pass filter means connected to input sides of said first and second level compression circuits.

* * * * *